US005282454A

United States Patent [19]

Bell et al.

[11] Patent Number: 5,282,454

[45] Date of Patent: Feb. 1, 1994

[54] JAM-FREE BULK LOADER FOR A PAINTBALL GUN

[75] Inventors: Roderick L. Bell; David W. Bell, both of Mesquite, Tex.

[73] Assignee: CM Support, Inc., Mesquite, Tex.

[21] Appl. No.: 963,993

[22] Filed: Oct. 20, 1992

[51] Int. Cl.[5] ..... F41B 11/02

[52] U.S. Cl. ..... 124/49; 124/56; 221/21; 221/200

[58] Field of Search ..... 221/6, 9, 10, 14, 21, 221/200; 124/45, 49, 50, 56; 453/17

[56] References Cited

U.S. PATENT DOCUMENTS

| | | | |
|---|---|---|---|
| 653,749 | 7/1900 | Mackay | 124/49 |
| 1,235,765 | 8/1917 | Brown | 221/200 X |
| 1,403,719 | 1/1922 | Szepe | 124/50 |
| 1,743,576 | 1/1930 | Smith | 124/49 |
| 1,789,206 | 1/1931 | Whatley | 124/49 X |
| 1,927,424 | 9/1933 | Trubenbach et al. | 124/49 X |
| 3,263,664 | 8/1966 | Bauer et al. | 124/49 |
| 3,348,531 | 10/1967 | Yano | 124/49 X |
| 3,476,100 | 11/1969 | Carbonneau | 124/49 X |
| 3,601,111 | 8/1971 | Embry | 124/49 X |
| 3,610,223 | 10/1971 | Green | 124/16 |
| 3,695,246 | 10/1972 | Filippi et al. . | |
| 3,749,280 | 7/1973 | Gale | 221/200 X |
| 3,844,267 | 10/1974 | Mohr | 124/1 |
| 3,867,921 | 2/1975 | Politzer | 124/26 |
| 4,207,857 | 6/1980 | Balka, Jr. | 124/56 |
| 4,405,060 | 9/1983 | Hsei | 221/200 X |
| 5,166,457 | 11/1992 | Lorenzetti | 124/49 X |

*Primary Examiner*—Randolph A. Reese
*Assistant Examiner*—John Ricci
*Attorney, Agent, or Firm*—Konnecker, Bush & Hitt

[57] ABSTRACT

An essentially jam-free bulk loader for a semi-automatic paintball gun includes a storage housing positionable above the gun infeed opening and adapted to hold a quantity of paintballs to be gravity fed to and fired by the gun. Extending downwardly from a bottom outlet opening in the housing is a feed tube having a bottom end portion connectable to outer end of the gun infeed elbow. During normal operation of the loader, a series of paintballs fall into the tube and infeed elbow and are vertically stacked therein for sequential downward delivery to the gu through the inner end of the infeed elbow. If a paintball jam occurs within the storage housing above its outlet opening during firing of the gun, a void is created in a top end portion of the feed tube above the downwardly moving paintball stack. An optical sensor detects the void and responsively actuates a motor driven agitator member within the storage housing adjacent its bottom outlet opening. The driven agitator member forcibly engages and shifts the jamming paintballs to permit additional paintballs to fall through the housing outlet opening into the feed tube and return the paintball delivery stack to its full operating height within the tube and infeed elbow. When this occurs, the sensor detects the filling of the tube void and responsively terminates the operation of the agitator member until it is needed again.

18 Claims, 2 Drawing Sheets

JAM-FREE BULK LOADER FOR A PAINTBALL GUN

BACKGROUND OF THE INVENTION

The present invention generally relates to paintball guns, and more particularly relates to bulk loader apparatus used in the sequential gravity feeding of a stored supply of paintballs to the infeed opening of a paintball gun.

The game of paintball has enjoyed great success in recent years and is one in which two or more "military" teams try to capture one another's flags. The players on the teams each carry a $CO_2$-powered gun that shoots paintballs—gelatin covered spherical capsules, about the size of bath oil beads, which contain a colored liquid. When a player is hit with a paintball from an adversary's gun, the paintball ruptures and leaves a colored "splat" on the hit player who is then "out" and must leave the game.

As the game of paintball has grown in sophistication, semiautomatic paintball guns—guns that sequentially fire individual paintballs as fast as the trigger can be repeatedly pulled—have become more prevalent. The high firing rate capability of semiautomatic paintball guns has necessitated the use of bulk loader devices in conjunction with such guns.

In a conventional form thereof, a bulk loader device typically comprises a housing which is positioned above and to one side of the gun. The housing is adapted to internally store a relatively large quantity of paintballs (for example 100–200 paintballs) and has a bottom outlet opening through which the stored paintballs can sequentially drop. Connected to the housing over its bottom outlet opening, and extending downwardly therefrom, is a feed tube that is connectable to the gun's hollow infeed portion—typically a hollow elbow member projecting outwardly from the body of the gun.

During normal operation of the loader, paintballs dropped through its housing outlet opening form a paintball stack, within the feed tube and gun infeed elbow, that is gravity fed to the gun during firing thereof and replenished at its top end from the loader housing. Paintball jams intermittently occur within the loader housing, above its outlet housing, during firing of the gun. These jams prevent the normal gravity delivery of paintballs downwardly through the housing outlet opening, with the result that the paintball stack can be totally depleted by several shots of the gun.

In the past, clearing of such jams has required that the gun be forcibly shaken to dislodge the paintballs causing the jam within the loader housing. This, of course, is highly undesirable since it interrupts the proper aiming of the gun and, of course, correspondingly interrupts the gun user's ability to continue the rapid firing of the gun. In view of this jamming problem typically associated with paintball guns provided with conventional bulk loader devices, it is an object of the present invention to provide a bulk loader device that overcomes or at least substantially reduces this jamming problem.

SUMMARY OF THE INVENTION

In carrying out principles of the present invention, in accordance with a preferred embodiment thereof, an essentially jam free bulk loader is provided for use with a paintball gun. Representatively, the paintball gun is a semiautomatic gun having a hollow infeed portion, in the form of an infeed elbow, which is adapted to receive a supply of paintballs from a source thereof and sequentially deliver the received paintballs to the gun, to reload it, in response to firing the gun.

The bulk loader is positionable generally above the gu and comprises housing means for internally storing a quantity of paintballs, the housing means having a bottom outlet opening through which the stored paintballs may sequentially drop. Feed tube means are connected to the housing means over the bottom outlet opening thereof and extend downwardly from the outlet opening. The feed tube means ar connectable to the gun infeed portion to form therewith a paintball gravity feed passage for receiving and holding a stack of paintballs dropped through the housing means bottom outlet opening and sequentially delivering the paintballs, by gravity from the lower end of the paintball stack, to the gun in response to firing thereof.

In accordance with a key aspect of the present invention, a specially designed jam clearing system is incorporated in the overall bulk loader apparatus and includes agitator means disposed in the housing means and selectively operable to clear a paintball feed jam therein by shifting a plurality of paintballs therein positioned adjacent the bottom outlet opening in a jamming orientation preventing operative downward exit of paintballs through the bottom outlet opening into the feed tube means. Control means are provided for sensing the absence of a paintball within an upper end portion of the feed tube means, indicative of the paintball feed jam, and responsively operating the agitator means to clear the paintball jam.

The agitator means representatively comprise an agitator paddle member positioned within the housing means and rotationally drivable in a manner causing an end portion of the paddle member to sweep across an interior section of the housing means positioned directly above a radially outer portion of the housing means outlet opening. The agitator paddle member is rotationally driven, through a gear train, by a small electric motor supported on the underside of the housing means and powered by a DC battery also supported on the housing means underside. The motor and battery are connected in series in a DC electrical circuit provided with a main on/off switch operable to selectively turn the jam clearing system on and off.

The control means illustratively comprise an infrared position sensing switch electrically connected in series with the other components of the jam clearing system and having emitter and receiver/switch portions operatively mounted on opposite sides of an upper end portion of the feed tube means. With the main system switch closed, and a paintball disposed in the upper end portion of the feed tube means the sensing switch beam is broken by the paintball and motor-driven rotation of the agitator paddle member is precluded.

However, if a paintball jam occurs within the housing means above its bottom outlet opening during sequential firing of the gun, the downwardly moving paintball stack within the feed tube means creates a void within the upper end of the feed tube means. The sensing switch emitter beam traverses this jam-created void, operatively strikes the receiver/switch portion of the sensing means, closes the jam clearing electrical circuit, and creates a driven rotation of the agitator paddle member to clear the housing means paintball jam.

The clearing of the jam rapidly causes the paintball stack to rebuild within the feed tube means until the uppermost paintball in the stack once again blocks the sensing means emitter beam, thereby opening the jam clearing system electrical circuit and terminating the operation of the agitator paddle member until it is needed again. Accordingly, the jam clearing system automatically operates only when it is needed, and is inoperative as long as paintballs drop as intended through the housing means bottom outlet opening and maintain the feed tube means paintball stack at its full operating height therein.

DETAILED DESCRIPTION

Figure 1:
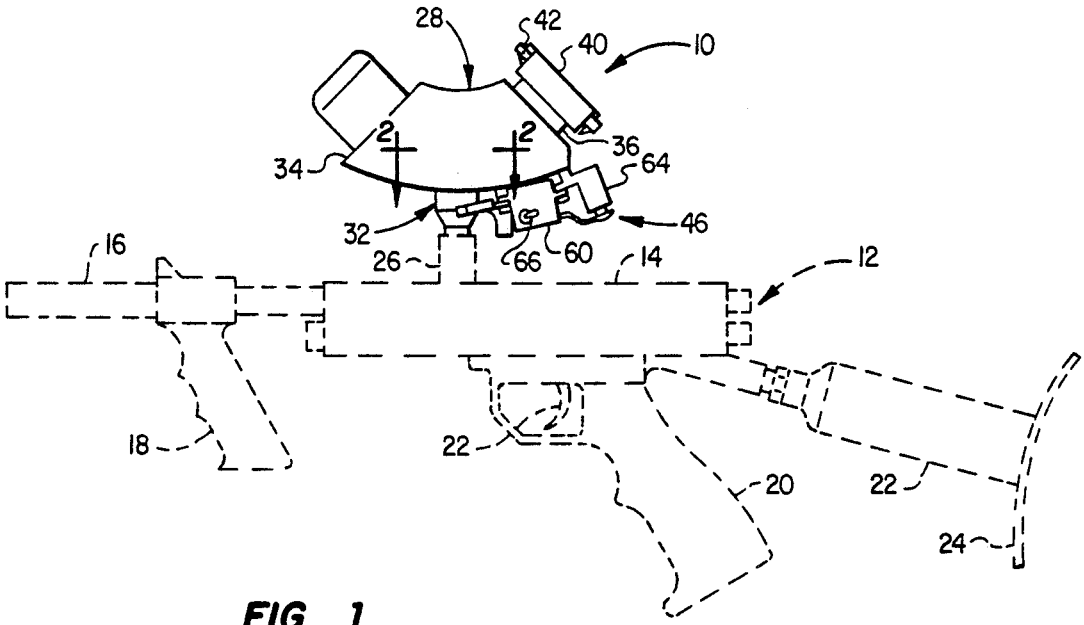
FIG. 1 is a side elevational view of a bulk loader which embodies principles of the present invention operatively attached to a representative paintball gun illustrated in phantom.

Illustrated in FIG. 1 is an improved bulk loader 10 that embodies principles of the present invention and is operatively connected to a representative paintball gun 12 of conventional construction and operation, the gun being shown in phantom. Gun 12 is representatively of the semiautomatic firing type and has a body portion 14; a barrel 16 with a front handgrip 18 depending therefrom; a central handgrip 20 having a trigger 22; and a rear stock portion defined by a $CO_2$ propellant gas canister 22 and provided at its rear end with a crooked shoulder rest portion 24.

The gun is conventionally fitted with an infeed portion in the form of a hollow, open-ended infeed elbow 26 that extends off to one side of the gun body 14 and then turns upwardly. The inner or bottom end of the elbow 26 communicates with a firing chamber (not shown) within the gun, the firing chamber in turn being operatively communicated with the canister 22. In a manner subsequently described, paintballs stored within the loader 10 are gravity fed downwardly into the firing chamber for sequential firing from the gun by pressure bursts from canister 22 created by sequential pulls of the trigger 22.

Figure 2:
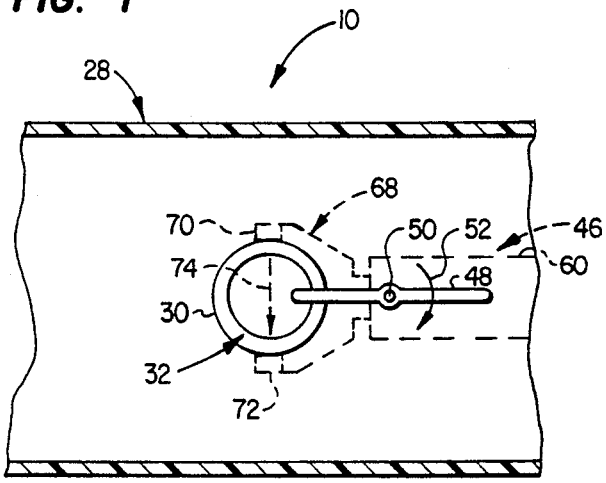
FIG. 2 is an enlarged cross-sectional view through a portion of the bulk loader taken along line 2—2 of FIG. 1.
Figure 3:
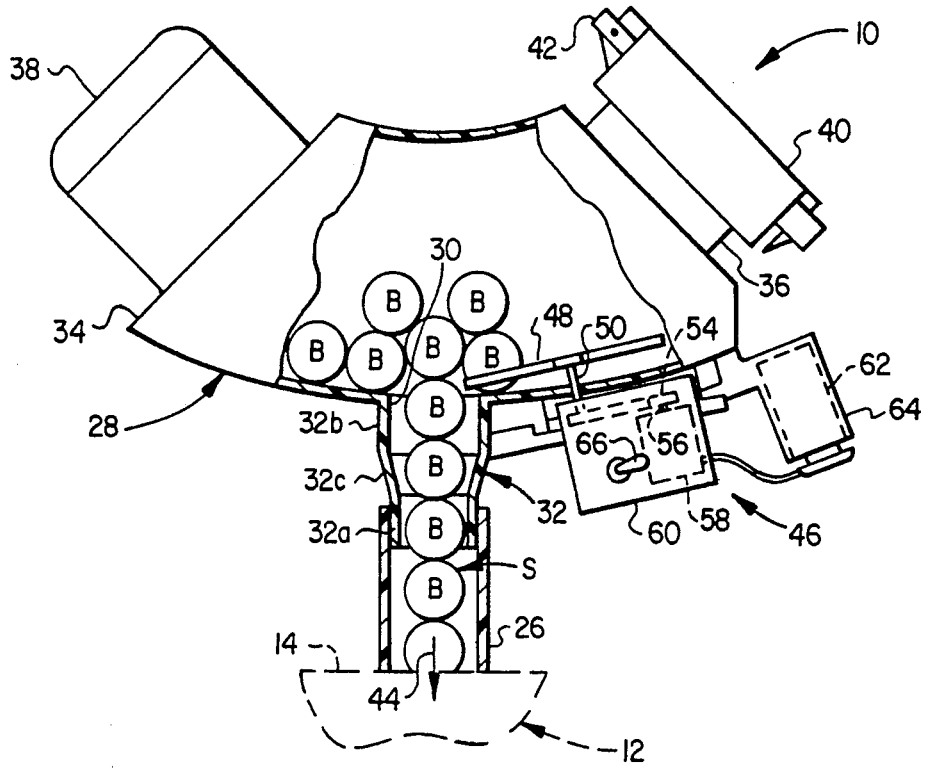
FIG. 3 is an enlarged scale, partially cut away side elevational view of the bulk loader during normal paintball feeding thereof to the gun.

Referring now to FIGS. 1-3, the bulk loader 10 has a hollow cylindrical housing 28 positioned above and to one side of the gun 15 body 14 and adapted to internally receive and store a quantity of paintballs B. Housing 28 is conveniently of a molded plastic construction and is bent along a downwardly curved longitudinal axis. A circular outlet opening 30 is formed in the bottom side of the housing 28 and has a diameter somewhat larger than the diameters of the stored paintballs B so that the paintballs can sequentially drop downwardly through opening 30 into a feed tube portion 32 of the loader that is secured to housing 28, over its outlet opening 30, and extends downwardly from the housing 28.

The feed tube 32 has an open lower end portion 32*a* removably received as shown in the upper end of the infeed elbow 26 and having an internal diameter just slightly larger than the diameters of the paintballs, but somewhat smaller than the diameter of the housing outlet opening 30 and the interior diameter of an upper end portion 32*b* of the feed tube 32. The upper and lower end portions 32*b*, 32*a* of the feed tube 32 are joined by a downwardly and radially inwardly tapered longitudinally intermediate portion 32*c* of the feed tube. This necked-down, enlarged upper end configuration of the feed tube 32, coupled with the diametrical oversizing of the housing outlet opening 30, facilitates the downward throughfeeding of the paintballs B from the housing interior to the lower end portion of the feed tube.

Housing 28 has open front and rear ends 34 and 36. Front end 34 is covered with an elongated hollow cylindrical cap 38 that may be removed to provide cleaning access to the interior of the housing 28 and is adapted to hold additional paintballs. Rear end 36 is covered by a transparent, disc-shape cap 40 that provides viewing access into the interior of the housing 28, and may be pivoted to an opened position, about a hinge structure 42, to permit paintballs to be loaded into the housing through open end 36 thereof.

Turning now to FIG. 3, during normal operation of the gun the housing-stored paintballs B sequentially fall downwardly through the housing bottom side outlet opening 30 and form a paintball stack S within the feed tube 32 and the gun infeed elbow 26 to which the feed tube is removably connected. As the gun is repeatedly fired, the stack S moves downwardly into the gun, as indicated by the arrow 44, and is continuously replenished at its top end by additional paintballs B falling through the housing outlet opening 30.

Figure 4:
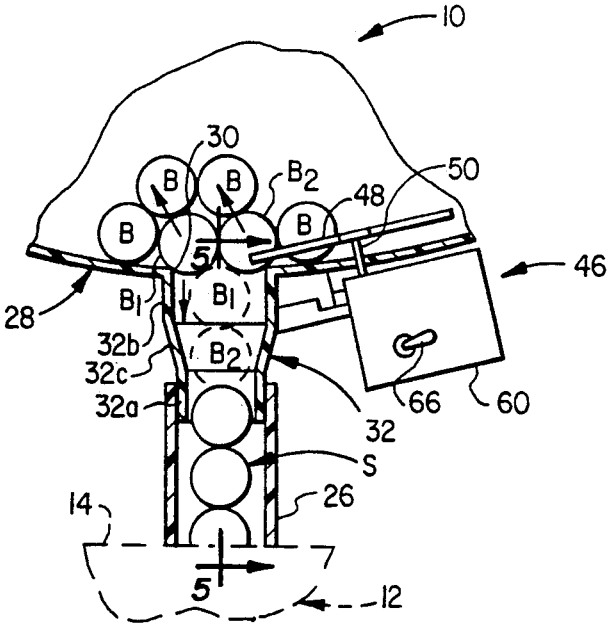
FIG. 4 is a view similar to that in FIG. 3 but illustrating a representative paintball jam within the loader housing portion, and the manner in which the jam is cleared via the operation of an automatic jam clearing system incorporated in the loader.
Figure 5:
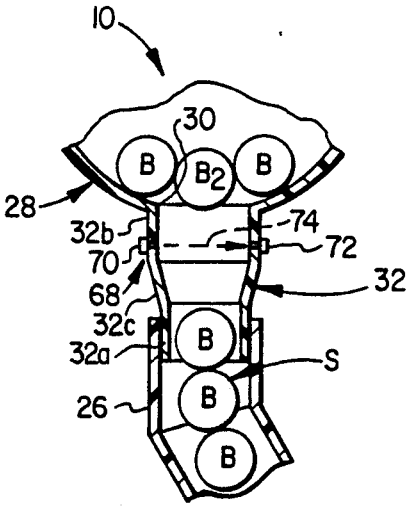
FIG. 5 is a cross-sectional view through the loader, and an infeed elbow portion of the gun, taken along line 5—5 of FIG. 4.

However, in the event that a plurality of paintballs (such as the representative paintballs $B_1$ and $B_2$ shown in FIGS. 4 and 5) jam within the housing 28 above its outlet opening 30, paintballs no longer drop onto the top of the downwardly moving stack S, and it can be rapidly depleted a the gun is being quickly fired. When such jamming occurs in conventional bulk paintball loaders, it is necessary to shake the gun and loader to dislodge the jamming paintballs and rebuild the paintball stack within the feed tube and gun infeed elbow. This previously necessary manual jam clearing procedure, of course, undesirable disrupts both the aiming and firing of the gun.

Referring now to FIGS. 2, 4 and 5, this problem is uniquely solved by the present invention via its provision of an automatic jam clearing system generally designated by the reference numeral 46. System 46 includes an agitator paddle member 48 disposed within the housing 28 outwardly adjacent its outlet opening 30 and centrally supported on a shaft 50 for driven rotation within the housing as indicated by the arrow 52 in FIG. 2. When the member 48 is rotationally driven in this manner, its outer ends sweep intermittently through an interior section of the housing 28 positioned above a right radially outer portion of the housing outlet opening 30 as viewed in FIG. 2.

The shaft 50 extends downwardly through the bottom side of the housing 28 and is connected, via a schematically depicted gear train 54 (see FIG. 3), to the output shaft 56 of a small electric motor 58 disposed within a casing 60 secured to the underside of the housing 28 behind the feed tube 32. Motor 58 is powered by a small DC storage battery 62 disposed within a casing 64 supported on the underside of housing 28 behind casing 60. The jam clearing system 46 may be selectively activated and deactivated using a manual on/off switch 66 externally mounted on casing 60.

Figure 6:
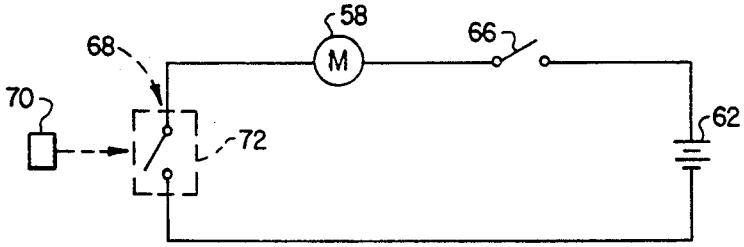
FIG. 6 is a schematic diagram of a DC electrical circuit utilized in the automatic jam clearing system.

System 46 also includes a generally yoke-shaped optical sensor structure 68 that exteriorly straddles the upper end portion **32*b* of the feed tube 32. The sensor structure 68 is of a conventional construction and has emitter and receiver/switch portions 70, 72 positioned on opposing side sections of the upper end portion 32*b* of the feed tube 32. As indicated in the schematic circuit diagram of FIG. 6, the motor 58, the battery 62, the on/off switch 66 and the sensor structure 68** are electrically connected in series with one another.

With the on/off switch 66 closed to activate the jam clearing system 46, the sensor structure emitter 68 is operative to transmit an infrared light beam 74 across the interior of the upper feed tube end portion **32*b* to the receiver/switch 72. During normal (i.e., unjammed) operation of the bulk loader 10, a paintball B disposed within the upper feed tube end portion 32*b* blocks the beam 74, thereby keeping the receiver/switch portion 72 in an open position and precluding energization of the motor 58 and corresponding driven rotation of the agitator paddle member 48**.

However, when a paintball jam occurs in the housing 28, as indicated in FIGS. 4 and 5, and the downwardly moving paintball stack S creates a void in the upper feed tube end portion **32*b*, the beam 74 strikes the receiver/-switch portion 72, thereby closing the overall jam clearing system circuit and responsively creating driven rotation of the agitator paddle member 48**.

The rotationally driven agitator member 48 strikes and dislodges the jammed paintballs $B_1$ and $B_2$ (see FIG. 4), freeing them to fall through the outlet opening 3 onto the top of the shortened paintball stack S, as indicated by the dotted line positions of the paintballs $B_1$ and $B_2$ in FIG. 4, and clearing the way for additional paintballs to fall through the outlet opening into the feed tube 32. As soon as a paintball (for example, the paintball $B_1$ in FIG. 4) enters the jam-created void within the upper end portion **32*b* of the feed tube 32, the infrared light beam 74 is broken by the upper paintball in the stack S, and the jam clearing electrical circuit is again opened to terminate the driven rotation of the agitator paddle member 48**.

As long as the paintballs B continue to drop into the feed tube 32 as required by the firing of the gun 12, the jam clearing system 46 is automatically prevented from operating by the continuous string of paintballs downwardly traversing the interior of the feed tube. However, as soon as a void is created in the upper feed tube end portion by a paintball jam within the housing above its outlet opening, the sensor structure 68 again automatically operates to sense the absence of a paintball in the upper end of the feed tube and responsively energize the system 46 to clear this subsequent jam.

Since the system 46 is operated only in response to the sensed absence of a paintball B within the upper feed tube end portion **32*b*, battery power is very efficiently utilized, thereby advantageously prolonging the operating life of the battery 62. When the gun 12 is to be transported or stored, the switch 66 is simply turned off to prevent th unintended activation of the jam clearing system 46. The system 46** is of a simple, rugged, and relatively inexpensive construction, yet reliably provides for automatic, on-demand paintball jam clearing without the previous necessity of manually shaking the gun and thereby disrupting both the aiming and firing thereof.

The foregoing detailed description is to be clearly understood as being given by way of illustration and example only, the spirit and scope of the present invention being limited solely by the appended claims.

What is claimed is:

1. For use with a paintball gun having a hollow infeed portion for receiving paintballs to be fired by the gun, bulk loader apparatus for supplying paintballs to the gun, said bulk loader apparatus being positionable generally above the gun and comprising:

housing means for internally storing a quantity of paintballs, said housing means having a bottom outlet opening through which the stored paintballs may sequentially drop;

feed tube means connected to said housing means over said bottom outlet opening thereof and extending downwardly therefrom, said feed tube means being connectable to the gun infeed portion to form therewith a paintball gravity feed passage for receiving and holding a stack of paintballs dropped through said housing means bottom outlet opening and sequentially delivering the paintballs, from the lower end of the paintball stack, to the gun in response to firing thereof;

agitator means disposed in said housing means and selectively operable to clear a paintball feed jam therein by shifting a plurality of paintballs therein positioned adjacent said bottom outlet opening in a jamming orientation preventing operative downward exit of paintballs through said bottom outlet opening into said feed tube means; and control means for sensing the absence of a paintball within said feed tube means, indicative of the paintball feed jam, and responsively operating said agitator means to clear the paintball jam.

2. The bulk loader apparatus of claim 1 wherein said control means include:

means for optically sensing the absence of a paintball within said feed tube means.

3. The bulk loader apparatus of claim 2 wherein:

said means for optically sensing are operative to sense the absence of a paintball within an upper end portion of said feed tube means.

4. The bulk loader apparatus of claim 3 wherein said means for optically sensing include:

an infrared position sensing structure having emitter and receiver/switch portions operatively positioned on opposite sides of said upper end portion of said feed tube means.

5. The bulk loader apparatus of claim 1 wherein:

said agitator means include a paddle member rotatably disposed within said housing means, and motor means operable to rotate said paddle member.

6. The bulk loader apparatus of claim 5 wherein:

said paddle member has an outer end portion positioned to sweep through an interior section of said housing means directly above a radially outer portion of said bottom outlet opening during driven rotation of said paddle member.

7. The bulk loader apparatus of claim 1 wherein:

the diameter of said housing means outlet opening and the interior diameter of an upper end portion of said feed tube means are larger then the interior diameter of a lower end portion of said feed tube means to facilitate the passage of paintballs from said housing means into said feed tube means.

8. The bulk loader apparatus of claim 7 wherein:

said upper and lower end portions of said feed tube means are joined by a downwardly and radially inwardly tapered longitudinally intermediate portion of said feed tube means.

9. The bulk loader apparatus of claim 1 wherein:

said housing means are downwardly curved, have a generally circular cross-section along their length, and have an open end provided with a removable transparent loading cap.

10. The bulk loader apparatus of claim 1 wherein:

said housing means longitudinally extend along a downwardly curved axis, have a generally circular cross-section along their length, and have an open end provided with a removable, hollow cleaning access cap elongated along said axis and adapted to hold an additional quantity of paintballs.

11. For use with a paintball gun having a hollow infeed portion for receiving paintballs to be fired by the gun, bulk loader apparatus for supplying paintballs to the gun, said bulk loader apparatus being positionable generally above the gun and comprising:

housing means for internally storing a quantity of paintballs, said housing means having a bottom outlet opening through which the stored paintballs may sequentially drop;

feed tube means connected to said housing means over said bottom outlet opening thereof and extending downwardly therefrom, said feed tube means being connectable to the gun infeed portion to form therewith a paintball gravity feed passage for receiving and holding a stack of paintballs dropped through said housing means bottom outlet opening and sequentially delivering the paintballs, from the lower end of the paintball stack, to the gun in response to firing thereof; and jam clearing means for sensing and automatically clearing a paintball jam within said housing means above said bottom outlet opening thereof, said jam clearing means including:

an agitator member supported for rotation within said housing means, an electric motor supported on said housing means and drivingly connected to said agitator member, a DC battery supported on said housing means, a manually operable on/off switch, and an optical position sensor switch structure mounted on an upper end portion of said feed tube means and operative to sense the presence or absence of a paintball within said upper end portion of said feed tube means, said electric motor, said DC battery, said manually operable on/off switch and said optical position sensor switch structure being electrically connected in series with one another.

12. Portable, hand-carryable paintball gun apparatus comprising:

a gas-operated paintball gun having an infeed passage for sequentially receiving paintballs to be fired by the gun;

a housing positioned generally above said gun and adapted to internally receive and store a quantity of paintballs, said housing having a bottom outlet opening through which the stored paintballs may sequentially drop;

a feed tube secured to said housing, over said bottom outlet opening, and extending downwardly therefrom, said feed tube being connected at a lower end thereof to said gun infeed passage to receive and hold therewith a stack of paintballs delivered from said housing for gravity feed into the gun in response to firing thereof;

agitator means disposed in said housing and operable to clear a paintball jam therein preventing exit of paintballs therefrom downwardly through said outlet opening; and control means for sensing the absence of a paintball within an upper end portion of said feed tube and responsively operating said agitator means until a paintball is disposed within said upper end portion of said feed tube.

13. The paintball gun apparatus of claim 12 wherein:

said agitator means include a paddle member carried within said housing for driven rotation relative thereto, and said control means are operative to rotationally drive said paddle member during the sensed absence of a paintball within said upper end portion of said feed tube.

14. The paintball gun apparatus of claim 13 wherein said control means include:

an electric motor supported on said housing and drivingly connected to said paddle member, a DC battery supported on said housing, a manually operable on/off switch, and an optical position sensor switch structure mounted on said upper end portion of said feed tube and operative to sense the presence or absence of a paintball within said upper end portion of said feed tube, said electric motor, said DC battery, said manually operable on/off switch and said optical position switch structure being electrically connected in series with one another.

15. The paintball gun apparatus of claim 12 wherein:

the diameter of said housing outlet opening and the interior diameter of said upper end portion of said feed tube are larger then the interior diameter of a lower end portion of said feed tube to thereby facilitate the passage of paintballs from said housing into said feed tube.

16. The paintball gun apparatus of claim 15 wherein:

said upper and lower end portions of said feed tube are joined by a downwardly and radially inwardly tapered longitudinally intermediate portion of said feed tube.

17. The paintball gun apparatus of claim 12 wherein:

said housing is downwardly curved, has a generally circular cross-section along its length, and has an open end provided with a removable transparent loading cap.

18. The paintball gun apparatus of claim 12 wherein:

said housing longitudinally extends along a downwardly curved axis, has a generally circular cross-section along its length, and has an open end provided with a removable, hollow cleaning access cap elongated along said axis and adapted to hold an additional quantity of paintballs.

* * * * *